US011698243B2

(12) United States Patent
Mason

(10) Patent No.: US 11,698,243 B2
(45) Date of Patent: Jul. 11, 2023

(54) ELEVATION ASSEMBLY FOR ARCHERY SIGHT

(71) Applicant: Gregory E. Summers, Madison Heights, VA (US)

(72) Inventor: Tristan Mason, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 307 days.

(21) Appl. No.: 17/219,976

(22) Filed: Apr. 1, 2021

(65) Prior Publication Data

US 2022/0316841 A1 Oct. 6, 2022

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265
See application file for complete search history.

(56) References Cited

U.S. PATENT DOCUMENTS 3,854,217 A * 12/1974 Killian ..... F41G 1/467 33/265
4,543,728 A * 10/1985 Kowalski ..... F41G 1/467 33/265
5,384,966 A * 1/1995 Gibbs ..... F41G 1/467 124/87
5,442,862 A * 8/1995 Newbold ..... F41G 1/467 124/87
5,507,272 A * 4/1996 Scantlen ..... F41G 1/467 124/87
5,941,226 A * 8/1999 Marietta ..... F41G 1/467 124/87
6,446,347 B1 * 9/2002 Springer ..... F41G 1/467 124/87
7,743,518 B2 * 6/2010 Khoshnood ..... F41G 1/467 124/87
8,689,454 B2 * 4/2014 Pulkrabek ..... F41G 1/467 124/87
8,839,525 B2 * 9/2014 Pulkrabek ..... F41G 1/467 124/87
9,500,434 B1 * 11/2016 LoRocco ..... F41B 5/143
(Continued)

*Primary Examiner* — George B Bennett
*Assistant Examiner* — G. Bradley Bennett
(74) *Attorney, Agent, or Firm* — Laubscher & Laubscher PC

(57) ABSTRACT

An elevation assembly for an archery sight includes a rail adapted for connection with a bow and having a plurality of spaced teeth extending from a surface thereof. An elevation block is mounted on the rail for reciprocal sliding movement between the ends of the rail. A pinion wheel is connected with the elevation block. The wheel includes a plurality of teeth which are configured to mesh with the pinion teeth of the rail. A knob is connected with the pinion wheel. Rotation of the knob rotates the pinion wheel to displace the wheel and the elevation block along the longitudinal axis of the rail for precise elevation adjustment of the archery sight. Pressing the knob along an axis normal to the rail longitudinal axis moves the pinion wheel along the normal axis away from the rail axis to disengage the pinion wheel teeth from the rail teeth and allow the elevation block to slide freely along the rail for quick course elevation adjustment of the sight.

8 Claims, 8 Drawing Sheets

(56) References Cited

U.S. PATENT DOCUMENTS

| | | | | |
|---|---|---|---|---|
| 9,612,087 | B2 * | 4/2017 | Summers | F41G 1/467 |
| 9,869,528 | B2 * | 1/2018 | Pellett | F41G 1/467 |
| 10,036,612 | B2 * | 7/2018 | Hamm | F41G 1/467 |
| 11,519,694 | B1 * | 12/2022 | Hamm | F41G 1/467 |
| 2003/0177651 | A1 * | 9/2003 | Stone | F41G 1/467 33/265 |
| 2017/0363389 | A1 * | 12/2017 | Lohan | F41G 1/467 |
| 2021/0207927 | A1 * | 7/2021 | Yasui | F41B 5/148 |

* cited by examiner

ELEVATION ASSEMBLY FOR ARCHERY SIGHT

BACKGROUND OF THE DISCLOSURE

Archery sights are used by hunters and competition archers to increase the accuracy of a shot. The sights are typically mounted on a bow. The sight includes a scope and an elevation rail which in turn is connected with an extension bar to a bow. More particularly, the scope is mounted on an elevation block which is displaceable along the elevation rail upon rotation of a knob or handle to gradually raise or lower the scope according to the archer's preference.

Some elevation assemblies use a rack and pinion type assembly to displace the elevation block along the rail. That is, the rail includes a plurality of teeth and serves as a rack. The elevation block includes a pinion such as a toothed wheel which engages the teeth of the rail. The wheel is connected with an external knob. Rotation of the knob in opposite directions displaces the wheel and the elevation block up or down the rail. Typically, one rotation of the knob displaces the elevation block a minimal distance of the rail.

While the prior rack and pinion elevation assemblies operate satisfactorily, it is somewhat laborious and time-consuming to repeatedly rotate the handle to displace the elevation block from one end of the rail to the other because of the limited movement of the elevation block per revolution of the knob. The present disclosure relates to an improved elevation assembly in which the teeth of a pinion wheel can be released from the teeth of an elevation rail for rapid movement of the elevation block to more quickly displace the elevation block along the rail for quick elevation adjustment. The teeth of the pinion wheel can be re-connected with the teeth of the elevation rail and then the knob can be rotated to more precisely position the elevation block and attached scope according to the preferences of the archer.

SUMMARY OF THE DISCLOSURE

Accordingly, it is a primary object of the disclosure to provide an elevation assembly for an archery sight including a rail having a longitudinal axis and a plurality of spaced teeth extending from one surface. An elevation block is mounted on the rail. The block is configured to slide along the rail between the rail ends. A pinion wheel is connected with the elevation block and includes a plurality of spaced teeth extending from a perimeter surface. The pinion wheel is displaceable relative to the elevation block and the rail along an axis normal to the rail longitudinal axis between an operating position wherein the pinion wheel teeth engage the rail teeth and a release position wherein the pinion wheel teeth are disengaged from the rail teeth. When the pinion wheel is in the operating position, the pinion wheel is operable to displace the elevation block relative to the rail and when the pinion wheel is in the release position, the elevation block is free to slide along the rail.

The teeth on both the rail and the pinion wheel have an angular configuration. Moreover, the space between the rail teeth increases in a direction toward the operating position of the pinion wheel and the space between the pinion wheel teeth increases in a direction toward the release position of the pinion wheel.

A knob is connected with the pinion wheel via a dowel arranged along the normal axis and extending into the elevation block. The knob is operable to rotate the pinion wheel to displace the elevation block relative to the rail and to displace the pinion wheel along the normal axis between the operating and release positions. A spring is arranged between the elevation block and the knob and biases the knob and pinion wheel toward the operating position.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1:
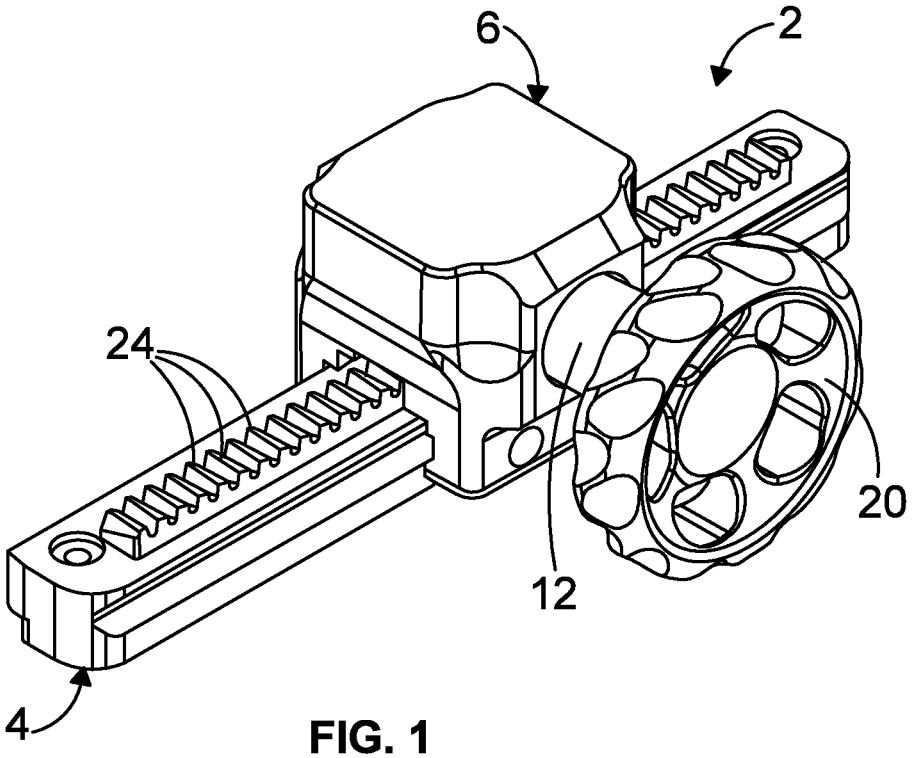
FIGS. 1-4 are front perspective, rear perspective, left side and top views, respectively, of an elevation assembly for an archery sight according to the disclosure.
Figure 2:
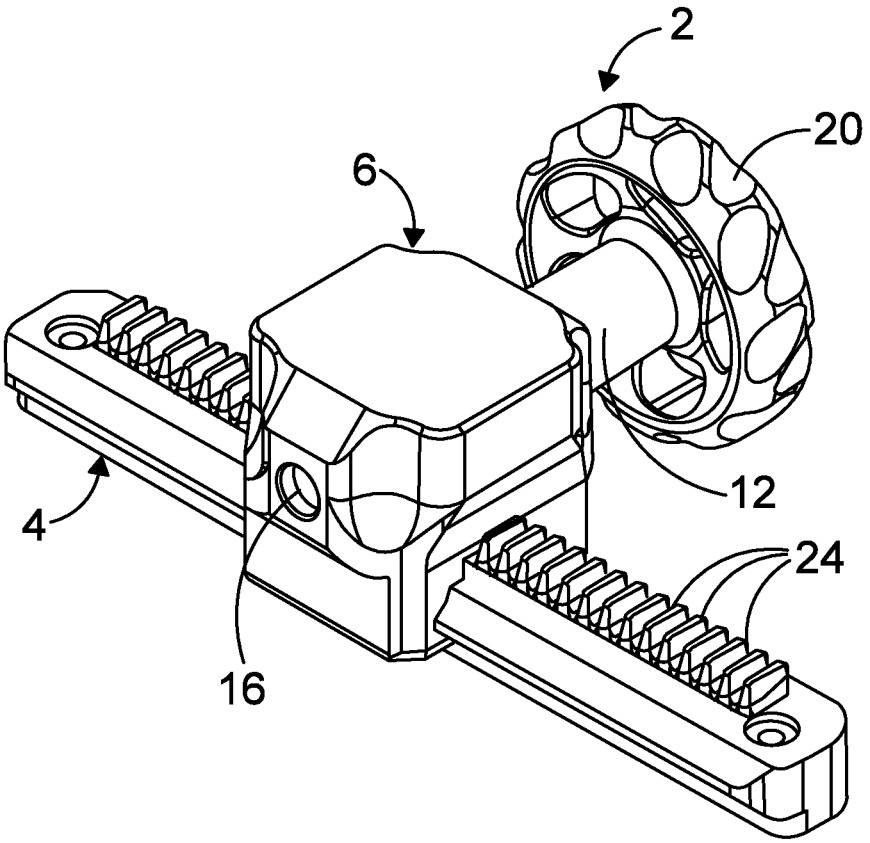
Figure 3:
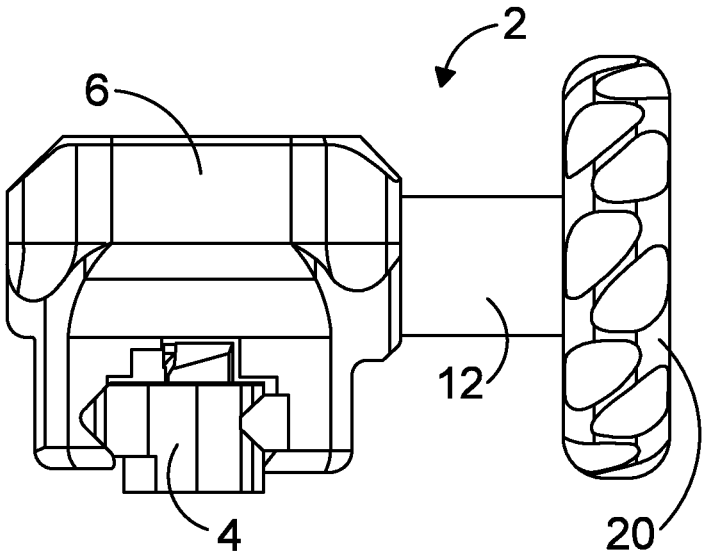

The elevation assembly 2 for an archery sight according to the invention is shown in FIGS. 1-6. The assembly includes an elevation rail 4 which extends in a longitudinal direction. The rail is connected with a mounting bar which in turn is connected with an archery bow used for hunting and/or competition. The mounting bar and bow are not shown in the drawing but are well known in the archery field.

An elevation block 6 is mounted on the rail for reciprocal movement along the longitudinal axis A of the rail. As shown more particularly in FIGS. 5 and 6, one side of the rail includes a lateral projection 4*a* and the other side of the rail contains a recess 4*b*. In addition, the elevation block 6 contains a chamber 8, with the rail 4 being arranged in the chamber lower portion. The elevation block is configured to mate with the rail. That is, one inner surface of the elevation block chamber contains a recess 6*a* in which the projection 4*a* of the rail is arranged. A gib 9 is connected with the elevation block and is arranged in the recess 4*b* of the rail. In a preferred embodiment, the gib is configured with a pair of spaced prongs or projections (not shown) which are arranged in spaced recesses in an inner wall surface of the elevation block. An archery scope (not shown) is connected with or mounted on the elevation block.

Figure 4:
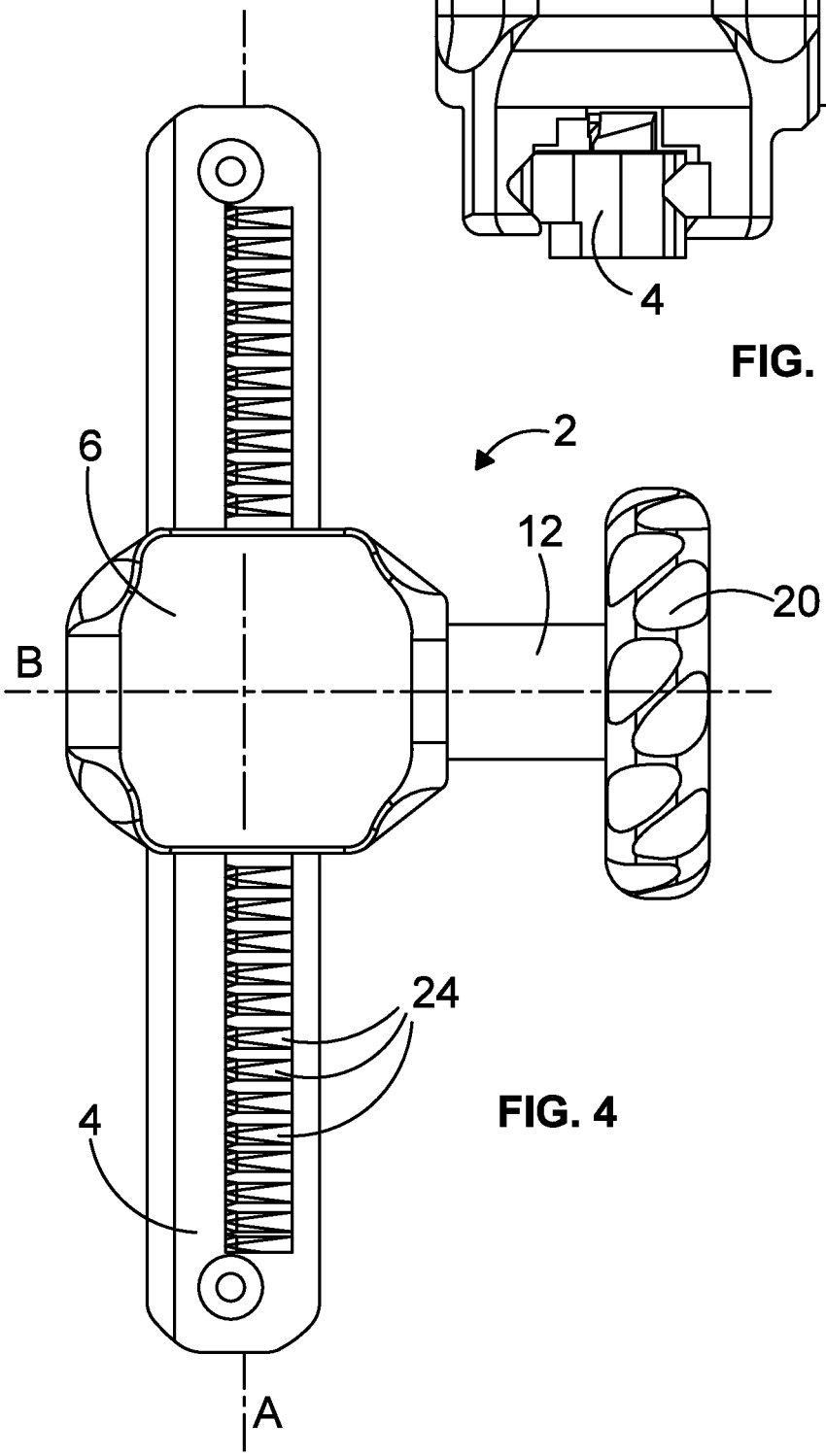
Figure 5:
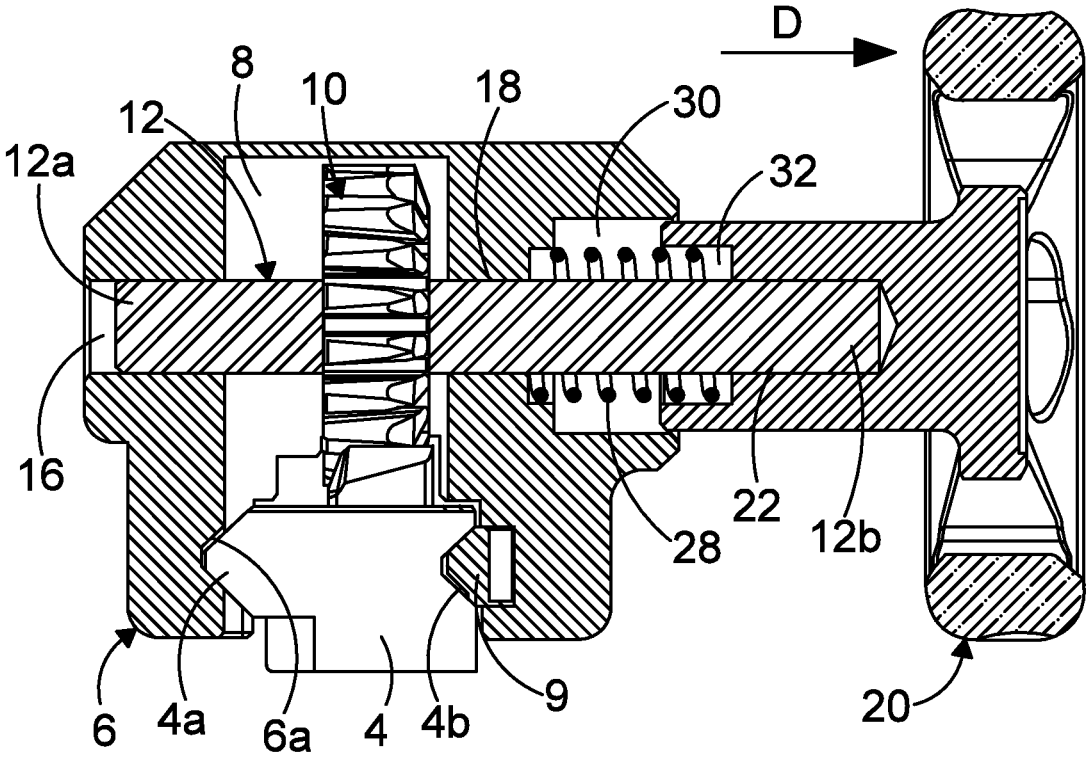
FIGS. 5 and 6 are section views of the elevation assembly in the operating and release positions, respectively.
Figure 6:
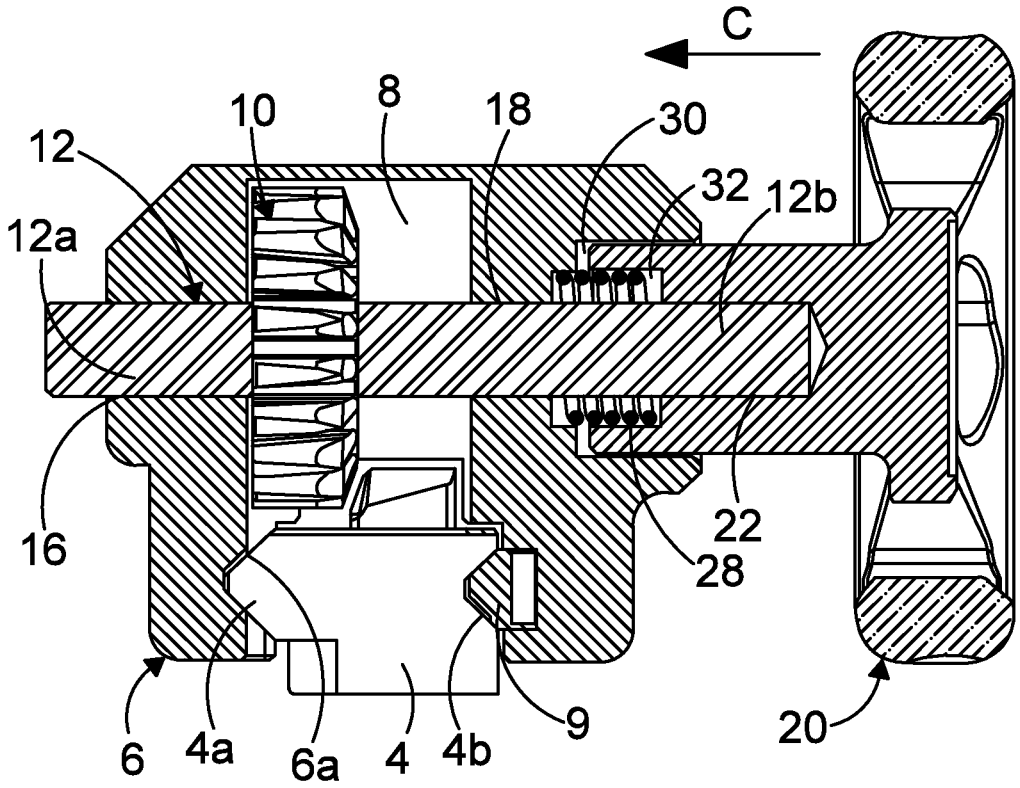

A pinion wheel 10 is arranged in housing chamber 8. The wheel 10 is mounted on a dowel 12 which has an axis B normal to the longitudinal axis A of the rail 4 as shown in FIG. 4. More particularly, the wheel contains a central opening 14 through which the dowel passes in a snug-fit relation. Accordingly, the wheel and dowel rotate together about the axis B. One end 12*a* of the dowel passes into a through opening 16 of the extension block 6. The through opening communicates with the chamber 8. An intermediate portion of the dowel 12 passes through a second through opening 18 of the extension block as shown in FIGS. 5 and 6. The diameter of the elevation block openings 16 and 18 is slightly larger than the outer diameter of the dowel 12 which allows the dowel to rotate relative to the elevation block 6. A knob 20 is connected with the opposite end 12*b* of the dowel 12. More particularly, the knob contains an opening 22 in which the end 12 of the dowel is retained in a snug-fit manner so that rotation of the knob rotates the dowel and wheel together.

Figure 7:
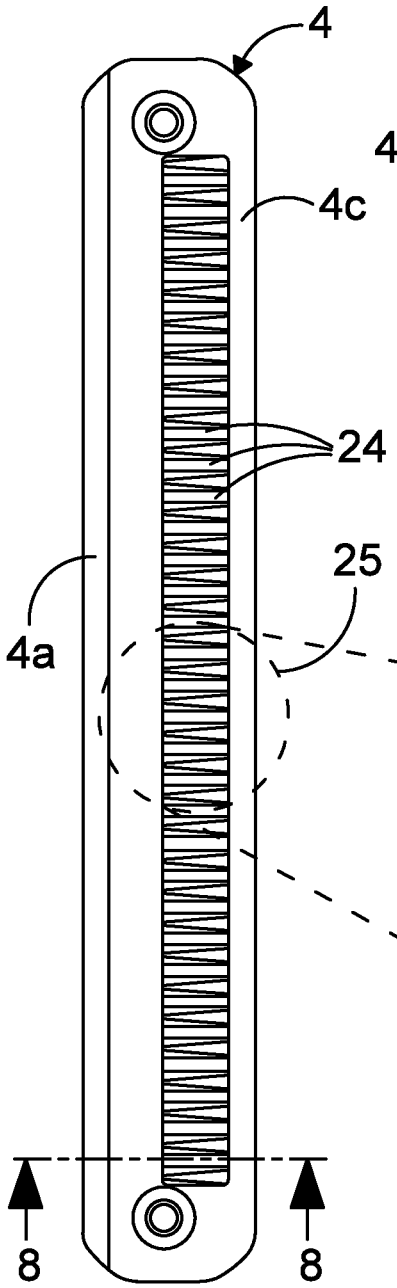
FIG. 7 is a top plan view of the rail of the elevation assembly.
Figure 8:
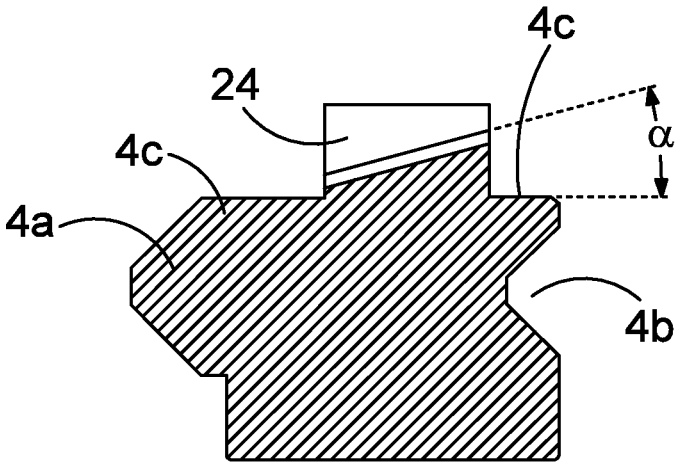
FIG. 8 is a sectional view of the rail taken along line 8-8 of FIG. 7.
Figure 9:
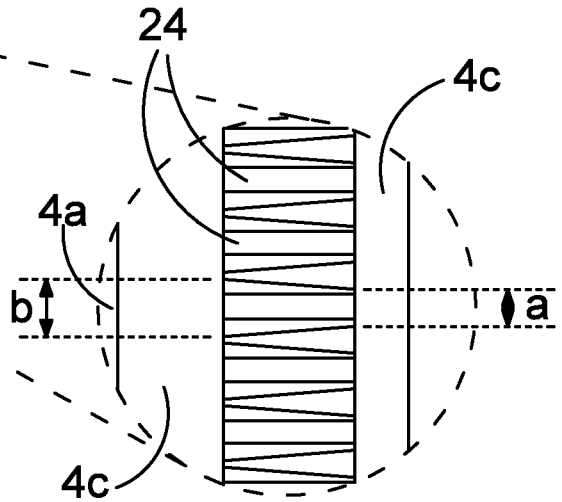
FIG. 9 is a detailed view of a portion of the rail of FIG. 7.

Referring to FIGS. 7-9, the rail 4 includes a plurality of spaced teeth 24 which extend from an upper surface 4*c*. The teeth are preferably equally spaced. Referring to FIG. 8, the rail teeth 24 are cut on an angle α relative to the upper surface 4*c* of the rail so that the teeth are tapered with a larger opening or spacing at the front and a smaller opening or spacing in the back. As shown in the enlarged portion 25 of the rail in FIG. 9, the distance a between the teeth 24 at the front of the rail, i.e. the edge of the rail which contains the recess 4*b* (FIGS. 5 and 6), is less than the distance b between the teeth at the rear of the rail, i.e. the edge of the rail which includes the projection 4*a*.

Figure 10:
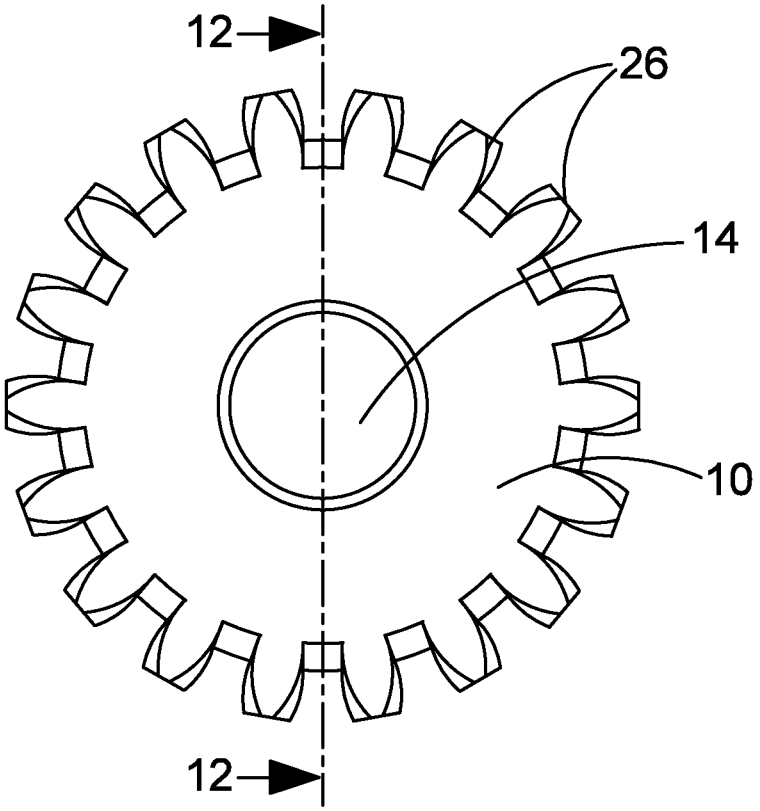
FIGS. 10 and 11 are front and top plan views, respectively, of the pinion wheel of the elevation assembly.
Figure 11:
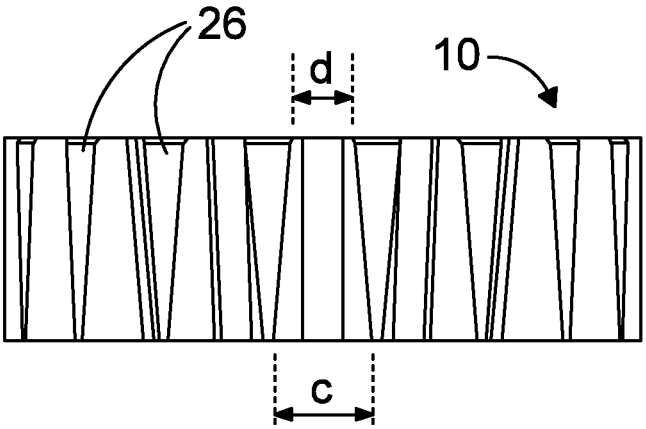
Figure 12:
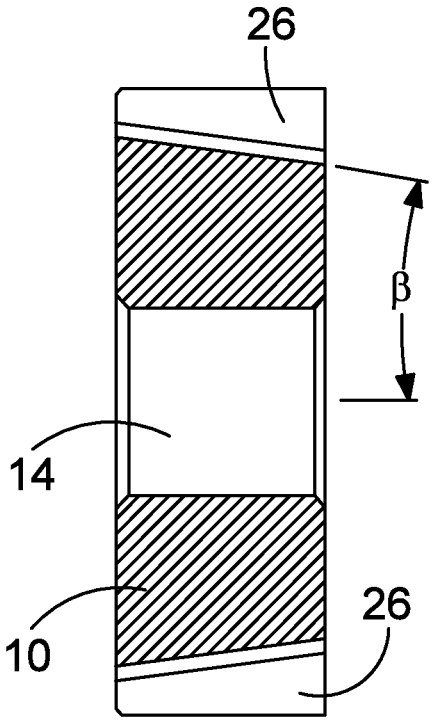
FIG. 12 is a section view of the pinion wheel taken along line 12-12 of FIG. 10.

Referring to FIGS. 10-12, the pinion wheel 10 includes a plurality of spaced teeth 26 which extend from the outer perimeter surface thereof. The teeth are equally spaced around the perimeter of the wheel. As shown in FIG. 12, the teeth are cut at an angle β relative to the axis of the wheel (which corresponds with the normal axis B of the elevation assembly) to provide a tapered tooth with a larger opening c between the teeth in the front of the wheel and a smaller opening d between the teeth in the rear of the wheel as shown in FIG. 11.

Figure 14:
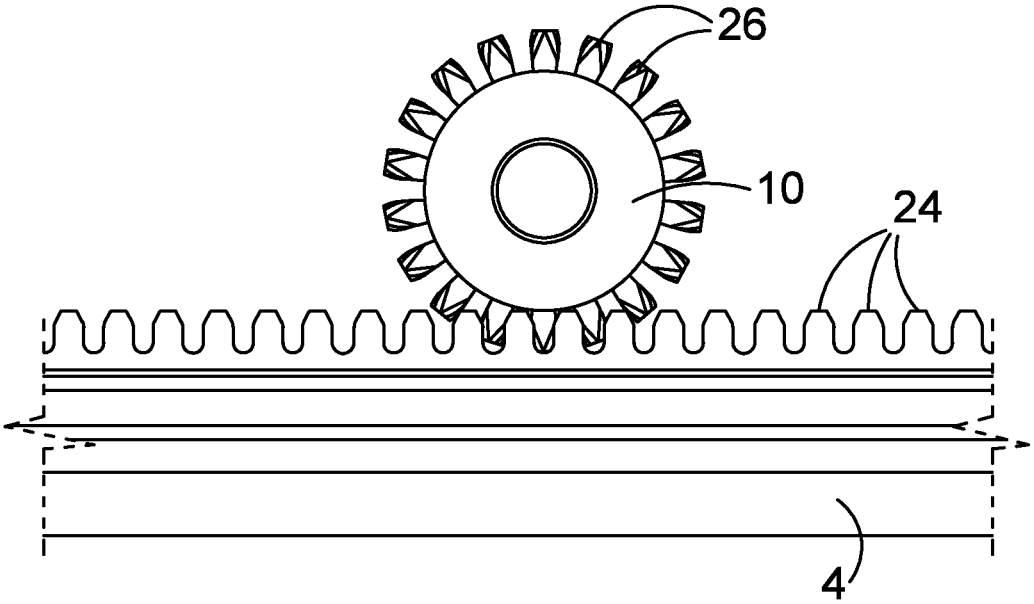
FIGS. 14 and 15 are front and rear views, respectively of the pinion wheel and a portion of the rail of the elevation assembly.
Figure 15:
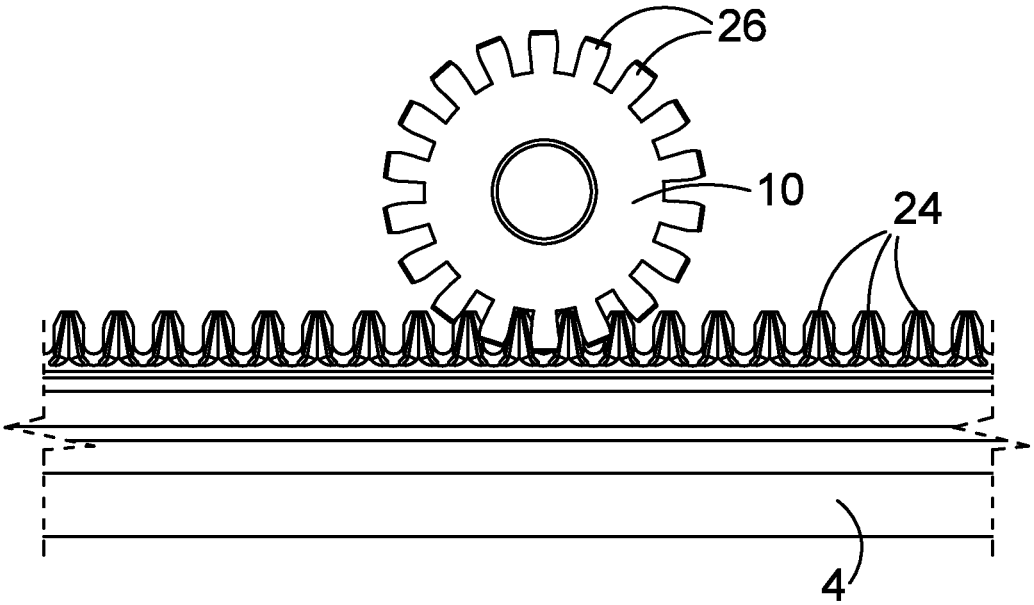

The configurations of the rail and wheel teeth are important in that they allow the teeth to easily mesh when the teeth are axially brought together along the normal axis B as shown in FIGS. 14 and 15.

Referring to FIGS. 5 and 6, the operation of the elevation assembly will be described. In FIG. 5, the teeth of the pinion wheel 10 are engaged with the teeth of the rail 4. This is the operating position. Rotation of the knob 20 rotates the dowel 12 and pinion wheel 10 to displace the wheel along the rail 4 as in a rack and pinion assembly. Because the elevation block is connected with the dowel, it moves with rotation of the wheel. Rotation of the knob in a first direction displaces the wheel and elevation block in one direction along the longitudinal axis of the rail and rotation of the knob in a second direction opposite the first direction displaces the wheel and elevation block in the opposite direction along the longitudinal axis of the rail. Thus, with an archery scope mounted on the elevation block and the rail connected with a bow and extending generally vertically, the elevation of the scope may be adjusted by the archer by rotating the knob in the appropriate direction. The elevation block and the gib are formed of a lightweight material such as aluminum and the elevation rail is formed of a synthetic plastic material. Thus, the block and gib slide easily relative to the rail upon rotation of the knob.

Figure 13:
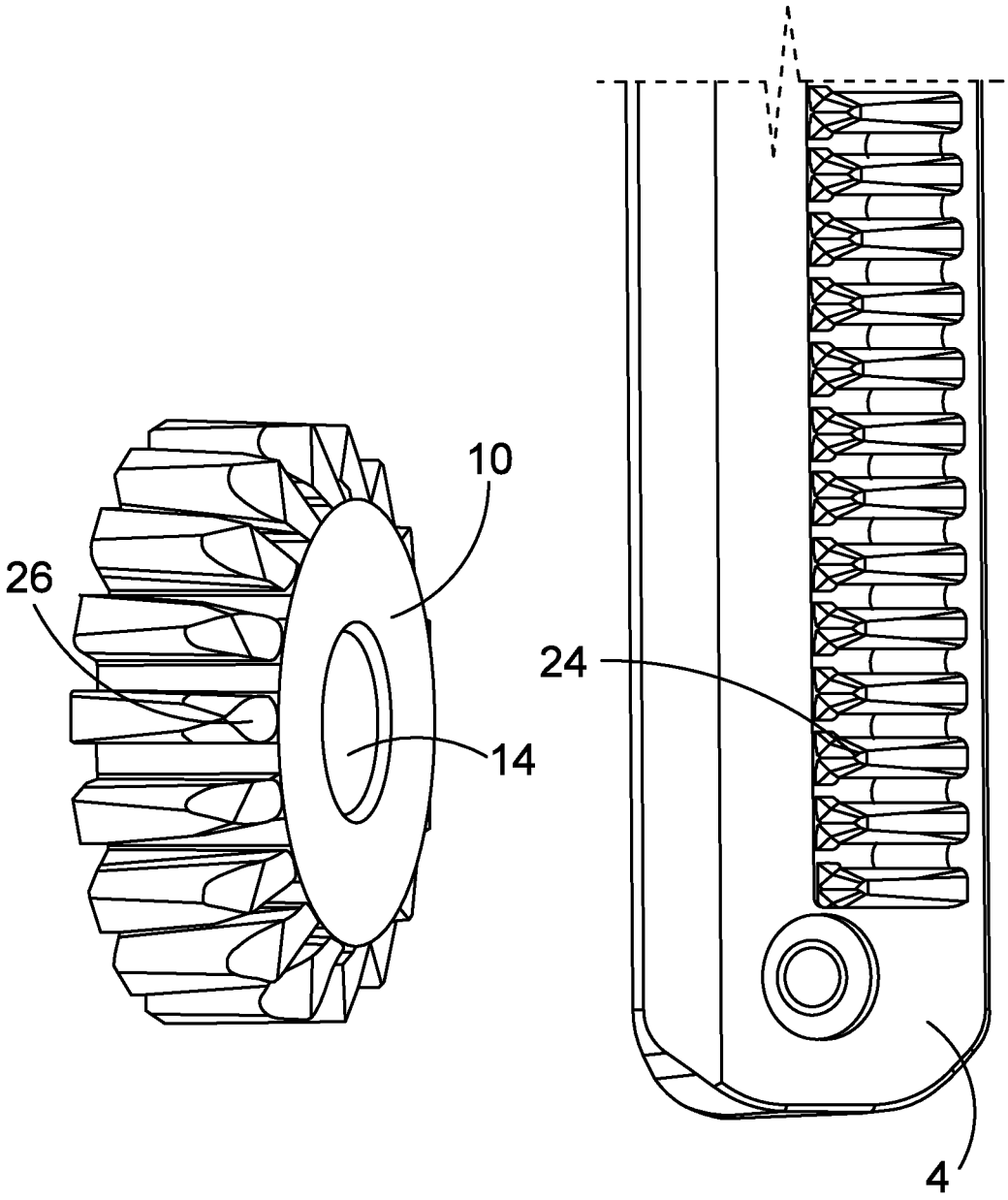
FIG. 13 is an exploded perspective view of the pinion wheel and a portion of the rail of the elevation assembly.

A unique feature of the elevation assembly is that the wheel may be disengaged from the rail in a release position as shown in FIGS. 6 and 13. By applying an axial force to the knob 20 in the direction of the arrow C, the knob 20, dowel 12 and pinion wheel 10 are moved relative to the elevation block 6. This disengages the wheel teeth 26 from the rail teeth 24. The elevation block chamber 8 is large enough to contain the wheel in the release position and the end 12*a* of the dowel protrudes from the through opening 16 of the elevation block. In the release position, the elevation block 6, as well as the dowel 12, pinion wheel 10 and knob 20, are free to move unencumbered along the rail for rapid adjustment of the elevation block and archery scope.

When the knob is released, that is, when the axial force is no longer applied to the knob in the direction C, the pinion wheel, dowel and knob are returned to the operation position shown in FIG. 5. The return force in a direction D shown in FIG. 5 is applied by a spring 28 which surrounds the dowel 12. For this purpose, the elevation block contains a second chamber 30 and the knob 20 contains a chamber 32 which communicates with the elevation block chamber and with the axial opening 22 in the knob. Moreover, the knob is configured to fit within the elevation housing second chamber 30 when the knob displaces the pinion wheel to the release position of FIG. 6. One end of the spring abuts against an end wall of the elevation block second chamber 30 and the other end of the spring abuts against an end wall of the knob chamber 32 as shown in FIG. 5. The spring normally biases the knob away from the elevation housing so that the normal position of the elevation assembly is the operating position shown in FIG. 5. With the spring compressed by the force C on the knob in the release position shown in FIG. 6, removal of the force C allows the spring to return the knob in the direction D to the operating position shown in FIG. 5.

The complementary construction of the teeth of the rail and the pinion wheel allows the teeth to easily mesh with virtually no slop or play when the assembly returns from the release position of FIG. 6 to the operating position of FIG. 5. Preferably, the angle α of the rail teeth is greater than the angle β of the pinion wheel teeth and the spacing c between the teeth at the front of the pinion wheel is greater than the spacing b between the teeth at the rear of the rail.

Accordingly, for rapid course adjustment in the elevation of an archery sight, the knob is pushed toward the rear of the elevation assembly to disengage the pinion wheel from the rail which allows the archer to slide the elevation block to a desired position. The knob is released and the pinion wheel teeth mesh with the rail teeth with little slop or play. The archer may then turn the knob sufficient to fine tune the elevation block and the archery sight to a precise position relative to the rail.

While the preferred forms and embodiments of the disclosure have been illustrated and described, it will be apparent to those of ordinary skill in the art that various changes and modifications may be made without deviating from the concepts set forth above.

What is claimed is:

1. An elevation assembly for an archery sight, comprising (a) a rail including a plurality of spaced teeth extending from a surface thereof;

(b) an elevation block mounted on said rail for reciprocal movement relative thereto; and (c) a pinion wheel connected with said elevation block, said pinion wheel including a plurality of spaced teeth and being displaceable relative to said elevation block and said rail between an operating position wherein said pinion wheel teeth engage said rail teeth and a release position wherein said pinion wheel teeth are disengaged from said rail teeth, whereby when said pinion wheel is in the operating position, said pinion wheel is operable to displace said elevation block relative to said rail, and when said pinion wheel is in the release position, said elevation block is free to slide along said rail.

2. An elevation assembly for an archery sight as defined in claim 1, wherein said rail has a longitudinal axis and said pinion wheel is displaceable relative to said elevation block along an axis normal to said rail axis.

3. An elevation assembly for an archery sight as defined in claim 2, wherein said rail teeth and said pinion wheel teeth are equally spaced and have a complementary configuration.

4. An elevation assembly for an archery sight as defined in claim 3, wherein said rail teeth and said pinion wheel teeth have an angular configuration.

5. An elevation assembly for an archery sight as defined in claim 4, wherein a space between said rail teeth increases in a direction toward the operating position of said pinion wheel and a space between said pinion wheel teeth increases in a direction toward the release position of said pinion wheel.

6. An elevation assembly for an archery sight as defined in claim 3, and further comprising a knob connected with said pinion wheel via a dowel arranged along said normal axis, said knob being operable to rotate said pinion wheel and to displace said pinion wheel along said normal axis.

7. An elevation assembly for an archery sight as defined in claim 6, and further comprising a spring arranged between said elevation block and said knob, said spring biasing said knob and said pinion wheel toward said operating position, whereby when an archer displaces said knob along said normal axis toward said release position against said spring, said pinion wheel teeth are disengaged from said rack teeth and said elevation block is free to slide along said rail.

8. An elevation assembly for an archery sight as defined in claim 7, wherein said elevation block contains a first chamber in which said pinion wheel is arranged and a second chamber in which said spring is arranged.

* * * * *